United States Patent [19]

Tanaka et al.

[11] 4,107,129

[45] Aug. 15, 1978

[54] ANTISTATIC ACRYLIC FIBER

[75] Inventors: Hiroyoshi Tanaka; Teruo Koseki; Shigeru Fujii, all of Ehime-ken, Japan

[73] Assignee: Toray Industries, Inc., Tokyo, Japan

[21] Appl. No.: 771,428

[22] Filed: Feb. 24, 1977

[30] Foreign Application Priority Data

Feb. 24, 1976 [JP] Japan ..... 51-18470

[51] Int. Cl.[2] ..... C08K 3/04

[52] U.S. Cl. ..... 260/40 P; 260/40 R; 260/42.48; 260/873; 260/898; 260/DIG. 15; 260/DIG. 16

[58] Field of Search ..... 260/40 P, 40 R, 42.48, 260/873, 898, DIG. 15, DIG. 17

[56] References Cited

U.S. PATENT DOCUMENTS

| | | | |
|---|---|---|---|
| 2,845,962 | 8/1958 | Bulgin | 260/DIG. 15 |
| 2,932,079 | 4/1960 | Dietzsch et al. | 428/374 |
| 3,075,241 | 1/1963 | Dietzsch et al. | 425/463 |
| 3,117,362 | 1/1964 | Breen | 260/DIG. 32 |
| 3,188,689 | 6/1965 | Breen | 425/463 |
| 3,270,777 | 9/1966 | Thompson | 260/42.48 |
| 3,330,899 | 7/1967 | Fukushima et al. | 264/210 F |
| 3,531,368 | 9/1970 | Okamoto et al. | 428/374 |
| 3,563,916 | 2/1971 | Takashina et al. | 260/42.48 |
| 3,625,915 | 12/1971 | Gubler et al. | 260/DIG. 17 |
| 3,801,553 | 4/1974 | Yamaguchi et al. | 260/DIG. 15 |
| 3,803,453 | 4/1974 | Hull | 428/375 |
| 3,848,028 | 11/1974 | Engelhard et al. | 260/898 |
| 3,963,803 | 6/1976 | Tanaka et al. | 260/873 |
| 4,035,441 | 7/1977 | Endo et al. | 264/171 |

*Primary Examiner*—Eugene C. Rzucidlo
*Attorney, Agent, or Firm*—Miller & Prestia

[57] ABSTRACT

An antistatic acrylic fiber having an electrical resistivity of about $10^8\Omega$ centimeters or less. The fiber comprises (A) an acrylonitrile homopolymer or copolymer and (B) an antistatic polymer comprising a plurality of polyether segments disposed in said polymer (A), and wherein electrically conductive carbon black is dispersed in antistatic polymer (B). Preferably antistatic polymer (B) extends in the form of long and slender stripes in the polymer (A).

14 Claims, No Drawings

ANTISTATIC ACRYLIC FIBER

This invention relates to an antistatic acrylic fiber having excellent process ability and which may be readily mixed or blended with other fibers in order to produce yarns, fabrics or other textile products having excellent antistatic properties. More particularly, this invention relates to an acrylic fiber having an electrical resistivity of about $10^8\Omega$ centimeters or less, and which comprises an acrylonitrile homopolymer or copolymer together with antistatic polymer comprising a plurality of polyether segments disposed in the acrylonitrile polymer, and wherein electrically conductive carbon black is dispersed in the antistatic polymer which comprises a plurality of polyether segments. Preferably in accordance with this invention, the antistatic polymer extends in the form of long and slender stripes in the polymer (A) and in some embodiments of the invention the long and slender stripes are substantially continuous and extend substantially parallel to the axis of the fiber.

PRIOR ART

Many approaches have been suggested to eliminate or reduce the static electricity in fabrics, for consumer comfort and to reduce the danger of explosion where explosive materials may be present in the vicinity of fabric utilization.

It has been suggested to intermingle minor amounts of metal fibers or metal plated polymer fibers randomly among synthetic hydrophobic fibers to minimize static in products made therefrom. This approach gives rise to considerable added cost. Further, the resulting metallic glitter may be undesirable. Further, such products are inferior in mechanical properties and in properties necessary for processing at the time of blending the fibers into fibrous products.

The use of fibers made of a synthetic polymer containing uniformly dispersed electrically conductive carbon black has been suggested. However, such carbon-loaded filaments cannot be produced at economically high speeds or at low cost. Moreover, such filaments tend to be brittle and are thus easily broken.

It has also been suggested to paste-coat filaments with conductive substances, or to soften the surfaces of synthetic polymer filaments, and thereafter to cause electrically conductive carbon black to be deposited on and to adhere to the surfaces. Unfortunately, these methods are expensive, and are subject to processing problems due to the slow speed of the operations. Furthermore, it is very difficult to obtain uniformity of deposition according to these methods.

In U.S. Pat. No. 3,803,453 a sheath-core antistatic filament is described. The core component preferably comprises a minor amount of the filament and contains electrically conductive carbon black. By completely encasing such a core component with a sheath of non-conductive polymer, one can utilize only a very small part of the conductivity provided by the carbon black.

At any rate, such physical or chemical methods are not adequate as methods for modifying general purpose synthetic fibers into conductive fibers, at low cost and in commercial production.

In a co-pending U.S. Application Ser. No. 482,463, filed June 24, 1974, now U.S. Pat. No. 4,035,441, assigned to the assignee hereof, an antistatic fiber or filament is disclosed which may be prepared by melt-spinning, utilizing static mixing elements interposed between separate molten polymer feed passageways and spinneret holes. Such fibers and filaments have a specific resistance less than $10^{11}$ cm., and are composed of a body of polyester having fine striae, disposed along the filament axis, of a polyether-polyester block copolymer. It is an object of this invention to provide fibers or filaments based upon acrylic polymers which are themselves substantially non-conductive, and to produce fibers or filaments which utilize the polyacrylonitrile structure but which have drastically lower specific resistance values of about $10^8\Omega$cm or less.

DESCRIPTION OF THE INVENTION

According to the present invention, we have provided an antistatic fiber consisting of a substantially non-conductive acrylic polymer (A) physically united with a conductive polymer component (B) containing electrically conductive carbon black. The conductive polymer includes a polyether structure and coacting particles of electrically conductive carbon black. The antistatic polymer component (B) comprises a plurality of polyether segments which are incorporated into but distinct in form from the acrylonitrile homopolymer or copolymer (A), and are shaped preferably as long and slender stripes at least some of which preferably extend in the direction of the fiber axis, as an independent phase in the acrylic polymer component (A) of the fiber. The antistatic stripes of component (B) are not limited in location to the core of the acrylic polymer component (A), but extend throughout it, and adjacent to and on its surface as well.

This method produces a novel synthetic filament. With such a filament it is possible to blend the antistatic fibers at will by using various well known methods or machines for blending or combining with other fibers, and fiber products can be obtained which have special properties or capabilities individually, because the mechanical and physical properties of the antistatic fibers according to the present invention are substantially equal to those of various standard fibers, especially in the case of acrylic fibers when various standard fibers are blended with antistatic fibers according to the present invention.

The antistatic fibers according to the present invention have a special structure. Conductive streaks or stripes of synthetic polymer, containing conductive carbon black, are incorporated into the acrylic fiber, and are preferably extended in the form of long and slender stripes in the general direction of the fiber axis as an independent phase in the non-conductive acrylic fiber. It is important that the carbon black be dispersed in the conductive synthetic polymer as uniformly as possible and that substantially all of it be contained in the conductive polymer, with little in the relatively non-conductive acrylic polymer. Therefore, it is desirable to use those antistatic polymers which are miscible but incompatible with the relatively non-conductive acrylic fiber, and to use a combination in which the carbon black has a stronger affinity for the antistatic polymer (B) than for the non-conductive acrylic polymer (A).

The ratio of carbon black to the antistatic polymer (B) varies according to the kind of antistatic polymer (B), especially the affinity and dispersability of the carbon black for and in the antistatic polymer. Usually the carbon black content is about 10–200%, preferably about 15–100%, based upon the weight of the antistatic polymer (B).

The antistatic fibers according to the present invention may be composite fibers consisting of conductive polyether segments containing carbon black as one or a plurality of cores or sheaths, and with the non-conductive acrylic polymer (A) as one or a plurality of cores or sheaths. However, it is possible to produce commercially suitable antistatic fibers by mix-spinning a mixed polymer suspension consisting of the above mentioned non-conductive acrylic polymer (A) and the conductive polymer (B) containing carbon black. Further, mix-spinning is more convenient and easier than composite spinning.

This invention is not limited, however, to production of random stripes of polyether-carbon as produced by mix-spinning but also extends to production of uniform stripes utilizing, for example, conjugate spinning or melt spinning as fully disclosed in the aforementioned U.S. patent application Ser. No. 482,463, filed June 24, 1974, the disclosure of which is incorporated herein by reference, in which continuous stripes are uniformly distributed within the (acrylic) non-conductive polymer, and are substantially endless. Examples of composite or conjugate fiber spinning methods and devices also appear in the U.S. Pats. to Okamoto et al No. 3,531,368 and Fukushima et al granted No. 3,330,899, assigned to the assignee hereof, and the disclosure of which is incorporated herein by reference. Utilizing such a special spinning procedure, conductive stripes may be provided at predetermined specific locations on the cross-section of the acrylic fiber, preferably at or adjacent the surface, and some or all of such stripes may be substantially endless if desired.

Other methods of spinning may be employed, without departing from the spirit of this invention. U.S. patents showing various composite filaments or fibers, and methods and devices for making the same include Dietzsch Nos. 2,932,079 and 3,075,241, and Breen Nos. 3,117,362 and 3,188,689, for example, the disclosures of which are incorporated herein by reference.

Acrylic polymers according to the present invention are fiber-forming linear polymers or copolymers of the type usually used for making acrylic fibers. Suitable acrylic polymers, for example, include copolymers consisting of more than 80 mol% acrylonitrile (AN) and less than 20 mol% of a comonomer which is able to copolymerize with AN, such as acrylic acid, methacrylic acid, itaconic acid, styrene, vinyl acetate, vinyl halides such as vinyl chloride and vinyl bromide, vinylidene halides such as vinylidene chloride, allylsulfonic acid, methallyl sulfonic acid, styrene sulfonic acid, and their alkali metals salts or ammonium salts, acrylamide, or methacryl amide, for example.

As antistatic polymer (B), it is preferred to use derivatives of polyalkylene glycol containing an alkylene glycol having an average molecular weight of at least about 1,000, preferably about 2,000 - 20,000 as the main unit. For example, in fibers according to the present invention, it is preferred to use a polyether-polyester block copolymer consisting of polyalkylene glycol such as polyethylene glycol (PEG), polypropylene glycol (PPG), polyoxyethylene oxypropylene glycol and aliphatic polyesters such as polyethylene adipate, polyethylene sebacate, polyethylene azerate, polybutylene adipate, polybutylene sebacate and aromatic polyesters such as polyethylene terephthalate, polybutylene terephthalate, polyethylene isophthalate, and polyether-polyester block copolymers obtained by graft copolymerizing a vinyl monomer such as AN on the above-mentioned polyether-polyester copolymer. The latter is preferable. Most of these conductive polymers are not soluble in water, but are soluble in the solvents for the acrylic polymer, especially organic solvents. Accordingly, it is possible to blend the acrylic polymer with the conductive polymer in any ratio.

As carbon particles, it is preferred to use carbon black having an electrical resistivity of less than about 10 Ωcm. Also, it is preferable to use carbon black having an average particle diameter of less than about 1 micron. Suitable carbon blacks include furnace black, channel black and acetylene black. These are easily miscible with an affinity for antistatic polymers (B), especially when furnace black is used. The term "carbon black" is intended to be generic.

The ratio of acrylic polymer (A) to antistatic polymer (B) may vary widely within the range in which it is possible to spin a mixed spinning solution by wet spinning, dry spinning or dry-wet spinning, which are well known spinning methods for acrylic fibers. However, the ratio of conductive polymer to total polymer is preferably about 2–45% by weight of the total polymer, and the ratio of acrylic polymer is preferably about 55–98% by weight of the total polymer. Adjustments within these ranges are readily made by skilled spinners by judging spinning processability and mechanical properties such as tenacity, heat resistance, wear resistance and fibrilation of the resulting fiber. The concentration of carbon black contained in the conductive polymer is about 10–200% by weight of the antistatic polymer (B) containing polyether segments, preferably about 15–100% by weight of said antistatic polymer (B). Outside this range it is not possible in a practicable manner to obtain enough conductive fiber or to spin the fiber well by use of the previously described spinning methods, or to produce the fiber economically.

The antistatic fiber according to the present invention has a specific structure wherein the conductive polymers are arranged substantially linearly along the axis of the acrylic fiber (the non-conductive fiber).

According to this invention, a fiber is provided wherein the conductive polymer is arranged linearly by composite-spinning or, on the other hand, arranged or dispersed in the form of a plurality of stripes, produced by mix-spinning.

When a mixed spinning method is used, a mixed polymer solution is provided which is obtained by dissolving the acrylic polymer and the conductive polymer in a solvent before spinning. The spinning solution must be stable and the conductive polymer must be oriented in the direction of the axis of the fiber by stretching in the mixed-spinning operation, after the solution is extruded through the spinneret orifices and the product coagulated.

An antistatic fiber may be obtained which is spun easily (and which has a novel structure according to the present invention) by selecting and using properly at least two types of polymers which are miscible but mutually incompatible when taken out of solution.

One of the characteristics of the fiber according to the present invention is that carbon black is dispersed as a multiplicity of stripes, and substantially in the direction of the axis, linearly with respect to the structure of the resulting fiber, and to the non-conductive potion thereof.

The fibers may be produced according to the present invention for the first time by dispersing the conductive polyether-carbon black segments in spaced relation in the acrylic polymer. Two solutions are prepared, one of acrylic polymer and the other of conductive polyether polymer, and they are mixed or formed into a suspension wherein a non-uniform mixture is provided; the conductive polyether polymer exists as an independent dispersed phase in the spinning solution, which has proper affinity for the acrylic polymer when the two polymer solutions are mixed. After extrusion, the conductive polyether polymer is shaped into long and slender stripes dispersed throughout the acrylic fiber and adjacent its surface, during the ensuing coagulation and drawing steps. In this situation the carbon black contained in the conductive polymer substantially completely remains with the (polyether) polymer with which it has been discovered to have an affinity. Hardly any of the carbon particles migrate to the acrylic polymer or to the liquid coagulant; accordingly, the mix-spinning step is easily carried into effect. The carbon remains in the conductive polyether polymer.

We have successfully obtained a fiber according to the present invention for the first time by combining the acrylic fiber with the above mentioned conductive polyether polymer, and by mix-spinning the acrylic polymer and the conductive polymer as will be further described. The carbon black may be caused to disperse uniformly and finely in the conductive polymer by mixing it with the conductive polymer solution at high shear. The rate of shear should be at least more than 1,000 $sec^{-1}$, preferably more than 5,000 $sec^{-1}$, using mixers known, for example, as "Homomic line flow", "Pipe line homomixer", (trademarks of Tokushu Kika Industries, cooperated) "Sand Mill", "Ball mill", "Homo mixer" and "Atrighter". If the rate of shear were less than 1,000 $sec^{-1}$, dispersion of carbon black would not be adequate.

As the use of a high-shear, high-speed mixer improves spinning time and stretch properties, the orientation of the conductive polymer in the direction of the axis of the fiber improves, and the antistatic properties are improved as well.

A dispersant for the carbon black can be used in order to stabilize the dispersion in the antistatic polymer (B), and to obtain good processability.

A nonionic surface agent may be employed, derived from polyoxyalkalene segments having a molecular weight of at least 500, which must be insoluble in water. The molecular weights of these dispersants preferably range from 1,000 – 3,000. Examples of suitable dispersants are copolymers consisting of tetramethylene oxide and ethylene oxide and/or propylene oxide. Such dispersants can stabilize the dispersed carbon black in the conductive polymer solution comprising antistatic polymer (B) derived from polyether segments, carbon black and an organic solvent such as dimethyl sulphoxide (DMSO), N, N-dimethylformamide (DMF) or N, N-dimethylacetamide (DMAC).

By the use of these dispersants the carbon black dispersion in the conductive polymer is stable even when the conductive polymer solution is mixed with acrylonitrile homopolymer or copolymer (A) solution, and the carbon black contained in the conductive polymer does not migrate to the acrylonitrile polymer (A), and the mixed polymer solution can be spun easily.

The antistatic fiber according to the present invention preferably consists of a conductive polymer in which carbon black is uniformly dispersed, using a dispersant. The ratio of dispersant to carbon black is about 5–300%, preferably about 10–150% by weight of carbon black.

The antistatic fiber according to the present invention has an electrical resistivity of less than about $10^8\Omega$.cm, preferably from about $10^2\Omega$.cm to $10^6\Omega$.cm. It has a tenacity of at least about 1.5 g/d and an elongation at break of at least about 10%, which is quite adequate when said fibers are blended as a minor component with other fibers or filaments.

The fiber of this invention is capable of providing excellent antistatic protection in essentially all types of textile end uses, including knitted, tufted, woven and nonwoven textiles in which it is preferably blended as a minor component.

Such fibers may be combined with other filaments or fibers during any appropriate step in yarn production (spinning, drawing, texturing, plying, rewinding, yarn spinning) or during fabric manufacture.

The invention is illustrated by the following Examples in which all parts and percentages are by weight unless otherwise indicated.

EXAMPLE 1

An acrylic polymer solution (A) and various polymer solutions (B), (C), (D), and (E) were prepared according to the following process.

(A) 195.5 parts of acrylonitrile (AN), 19.5 parts of methylacrylate (MA), 2.2 parts of sodium allyl sulphonate, 10 parts of water, 3.3 parts of azobisisobutyronitrile and dodecyl mercaptan (DM) were dissolved in 760 parts of DMSO inside a polymerization vessel and polymerization of this mixture was carried out by heating at a temperature of 50° C for 35 hours, with mechanical agitation.

(B) 10 parts of polyvinylalcohol (PVA) were dissolved in 90 parts of DMSO. 5 parts of furnace black having an average particle diameter of 20 mμ were added. A PVA polymer solution containing dispersed furnace black was prepared by mixing the two in a high shear mixing machine for 30 minutes. The PVA concentration of this PVA solution was 10% by weight of the total solution.

(C) Substantially following the procedure described in Example 1 (B) using polyvinylpyrrolidone (PVP) instead of PVA, a PVP solution containing the same amount of dispersed furnace black of the same particle size was prepared. The PVP concentration of the above mentioned solution was 10% by weight of the total solution.

(D) Substantially the procedure described in Example 1 (B) was followed, using polyethylene oxide having a molecular weight of about 100,000 instead of polyvinylalcohol. This polyethylene oxide was identified as "Alkox R-150" (trademark of Meisei Kagaku Kogyo Company of Japan). In this manner, a polyethylene oxide solution containing the same amount of furnace black of the same particle size was prepared. The polyethylene oxide concentration of the above mentioned solution was 10% by weight of the total solution.

(E) A batchwise esterification apparatus was charged with adipic acid, azelaic acid, ethylene glycol and tetraisopropyl titanate, and an esterification reaction was carried out at 200° to 220° C for 5 hours. 30 parts of the reaction product were transferred to a polycondensation reactor, to which product were added 70 parts of polyethylene glycol (PEG) (numerical average molecular weight about 4,000) and tetraisopropyl titanate and a polycondensation reaction was carried out at 250° C for 5 hours under a reduced pressure of 0.1 to 1 mm Hg to obtain a polyether-polyester block copolymer. A block polyether-ester comprising polyethyleneadipate/azelate and polyethylene glycol was dissolved in DMSO. Substantially following the procedure described in Example 1 (B) a block polyether-ester solution containing dispersed furnace black in the same quantity and of the same particle size was prepared. The concentration of the polyether-ester in the total solution was 10% by weight.

(F) 70 parts of the above mentioned polyether-ester were dissolved in 630 parts of DMSO. 30 parts of AN, ammonium persulfate (APS) and DM were added to the resulting polyether-ester solution. The resulting mixture was graft-copolymerized in DMSO at 55° C for 11 hours, and a graft copolymer solution was prepared.

(G) By a method substantially the same as that if Example 1 (E), a block polyether-ester comprising polyethylene adipate and polyethylene glycol (molecular weight about 2,000) was prepared. The ratio of polyethylene adipate to polyethylene glycol was 25 wt% to 75 wt%.

100 parts of block polyether-ester were dissolved in 870 parts of DMSO. 30 parts of AN, APS, DM were added to the resulting polyether-ester solution. The graft copolymer solution was prepared by stirring the resulting mixture at 50° C for 22 hours. Each of the polymer solutions (B), (C), (D) and (E) was mixed with the acrylic polymer solution (A) obtained in Example 1 to prepare spinning solutions. At this time, the amount of carbon black component in the total polymer mixture was 7.0% by weight in each of the spinning solutions. Each of these spinning solutions was extruded through a spinneret having 400 orifices each having a diameter of 0.08 mm and solidified in a 50% aqueous solution of DMSO at 25° C.

The resulting fibers were stretched 5 times original length in an aqueous solution containing 10% of DMSO at a temperature of 98° C.

The fibers thus obtained were next washed with water and dried for 15 minutes at 135° C. Their antistatic properties were determined by using the following test methods on the resulting tows.

Measurement of antistatic properties was accomplished in the following manner. The electrical resistance in ohms of a tow sample 10 cm long, 20,000 denier was measured by securing it between two terminal clamps, spaced approximately 10 cm away from an ohmmeter in air having a relative humidity of 30% and at a temperature of 20° C. The resulting value for resistance (R) was converted to electrical resistivity by the following equation:

$$\text{Electrical resistivity} = \frac{R \times \text{denier}}{9 \times 10^6 \times \text{specific gravity}}$$

The results of the tests appear in Table 1 which follows:

TABLE 1

| Mixed polymer solution No. | Polymer solution (dispersed carbon black) | Electrical Resistivity (Ω cm) |
|---|---|---|
| A + B | PVA | $1.7 \times 10^{13}$ |
| A + C | PVP | $1.1 \times 10^{13}$ |
| A + D | PEO | $8.0 \times 10^{3}$ |
| A + E | block polyether-ester (PEG) | $3.5 \times 10^{3}$ |

EXAMPLE 2

Channel black having a particle size of 16 mμ was added to the graft polymer solution of DMSO obtained in Example 1-(F). In a series of tests the ratio of carbon black to graft polymer was varied in runs of 5, 10, 20, 30, 50 and 100% ratio of carbon black to graft polymer.

Each of the polymer solutions containing carbon black was prepared by mixing in a high-shear mixing machine for 30 minutes. Each of these polymer solutions was mixed with the acrylic polymer solution (A) to prepare the spinning solution. At this time, the amount of the carbon black in the total polymer mixture was 7% by weight, in each of the spinning solutions. Following the procedure described in Example 1, each of the fibers was spun from each of the spinning solutions and antistatic properties were determined. The results are shown in Table 2.

TABLE 2

| Ratio of carbon black to graft polymer (parts per 100 parts polymer) | Electrical Resistivity (Ω . cm) |
|---|---|
| 5 | $9.5 \times 10^{7}$ |
| 10 | $7.7 \times 10^{6}$ |
| 20 | $1.7 \times 10^{5}$ |
| 30 | $7.2 \times 10^{3}$ |
| 50 | $1.0 \times 10^{2}$ |
| 100 | $8.3 \times 10^{3}$ |

EXAMPLE 3

Furnace black having a particle size of 29 mμ was added to the graft polymer solution of DMSO obtained in Example 1-(F). At this time the ratio of carbon black to graft polymer in the compostion was 80% by weight.

A polymer solution containing finely dispersed furnace black was obtained by the method described in Example 2. In a series of tests in which the composition was varied as to the ratio of graft copolymer to acrylic polymer obtained in Example 1, the polymer solution containing furnace black was mixed with the acrylic polymer solution (A) and spinning solutions were prepared and mix-spun. Each fiber was obtained by the method described in Example 2 and its electrical resistivity was measured. The results are reported in Table 3.

TABLE 3

| Acrylic polymer/ graft polymer (%) | Tenacity (g/d) | Elongation (%) | Electrical Resistivity (Ω . cm) |
|---|---|---|---|
| 100 / 0 | 3.5 | 31.0 | $1.9 \times 10^{13}$ |
| 95 / 5 | 3.1 | 30.8 | $2.1 \times 10^{7}$ |
| 80 / 20 | 2.1 | 25.7 | $2.8 \times 10^{2}$ |
| 70 / 30 | 1.5 | 20.9 | $1.5 \times 10^{1}$ |
| 50 / 50 | 0.9 | 10.5 | $5.1 \times 10^{0}$ |
| 40 / 60 | 0.7 | 8.2 | $2.1 \times 10^{0}$ |

EXAMPLE 4

Furnace black having a particle size of 20 mμ was added to the graft polymer solution of DMSO obtained in Example 1-(G). At this time the composition ratio of carbon black to graft polymer was 35% by weight.

Varying the dispersants for the carbon black, each of the dispersants was added to the above mentioned graft polymer solution and the furnace black. In the tests the amount of dispersant was 40% by weight of the graft polymer.

Mixtures were prepared by the method described in Example 2 to prepare a conductive master polymer solution. Settling and agglomeration of the various conmaster polymer solutions were observed, and thereafter each of the conductive master polymer solutions was mixed with acrylic polymer solution (A) by the method described in Example 2 to prepare spinning solutions. Each spinning solution was wet-spun, and presence or absence of migration of carbon black to the liquid coagulant was determined. The results are shown in Table 4.

TABLE 4

| Dispersant | Settling or agglomeration | Carbon black migration to liquid coagulant |
|---|---|---|
| Sodium naphthionate | O | X |
| Sodium lignin sulfonate | O | X |
| Sodium naphthalene-sulfonate | O | X |
| Dioctyl phthalate | X | O |
| Melamine | X | X |
| Polyethylene glycol (MW : 600) | O | X |
| Ethanol amine | X | X |
| Polyoxyethylene-oxytetramethylene-glycol | O | O |

O : Absent
X : Observed

EXAMPLE 5

As dispersant, polyoxyethylene oxytetramethylene glycol (ratio of ethylene oxide to tetramethylene oxide 50/50 mol) was added to graft polymer solution (G) containing furnace black.

Varying the amount of polyoxyethylene-oxytetramethylene-glycol by weight of the furnace black, each of the conductive polymer solutions was prepared and mix-spun by the method described in Example 5.

The spinnable time of each mixed-polymer solution was checked, and each fiber obtained was tested to determine its electrical resistivity. The results are shown in Table 5.

TABLE 5

| Dispersant/furnace black (%) | Spinnable time (hr.) | Electrical Resistivity (Ω . cm) |
|---|---|---|
| 0 | 2.5 | $8.5 \times 10^3$ |
| 5 | 9.2 | $3.2 \times 10^3$ |
| 50 | 10 | $2.1 \times 10^3$ |
| 100 | 10 | $2.5 \times 10^3$ |
| 300 | 10 | $8.1 \times 10^3$ |
| 350 | 7.2 | $1.2 \times 10^5$ |

EXAMPLE 6

Following the procedure described in Example 5, a fiber was obtained.

The amount of furnace black was 7.0% by weight of said fiber and the amount of dispersant was 5.5% by weight of said fiber. The above mentioned fiber had the following properties:

| | |
|---|---|
| Denier | 2.5 d |
| Tenacity | 2.3 g/d |
| Elongation | 35.5% |

Electrical Resistivity $2.1 \times 10^3$ Ω.cm

Said antistatic fiber was crimped and cut to 38 mm and the cut fibers were blended with poly (ethylene terephthalate) staple fiber and spun into yarn in separate runs in different proportions to give 0.2, 0.5 and 1.0% of said antistatic fiber in the resulting blended yarn.

The antistatic fiber had excellent processability and it was easy to spin the blended yarns.

The blended yarns containing 0.2, 0.5 and 1.0% of carbon-containing fibers had electrical resitivities, measured at 30% relative humidity after scouring and rinsing, of $8.5 \times 10^8$Ω.cm, $7.2 \times 10^7$Ω.cm and $4.5 \times 10^7$Ω.cm respectively.

The blended yarns were used to manufacture fabrics which exhibited excellent antistatic properties.

The surprising electrical resitivities attainable according to this invention do not appear to be caused by the presence of carbon black alone. The presence of the polyether units in combination with dispersed carbon black produces results we consider quite surprising. Referring to Table 1, for example, stripes of PVA or PVP containing carbon black produced electrical resistivities of the polyacrylonitrile on the order of $10^{13}$Ωcm. By sharp contrast, those based upon the polyethylene oxide concept produced electrical resistivities on the order of $10^3$ cm.—a surprising difference on the order of $10^{10}$Ωcm.

Although this invention has been described with reference to specific Examples, it will be appreciated that equivalent chemicals, polymers and electrically conductive particles are intended to be included herein, and that the specific Examples in this specification are not intended to limit the scope of the invention as defined in the appended claims.

We claim:

1. An acrylic fiber having an electrical resistivity of about $10^8$Ω.cm. or less, comprising (A) an acrylonitrile homopolymer or copolymer comprising at least about 80 mol% of acrylonitrile and up to about 20 mol% of at least one copolymerizable vinyl monomer and (B) an antistatic polymer which are miscible but incompatible with the acrylonitrile homopolymer or copolymer, and wherein the amount of acrylonitrile polymer (A) is about 55–98% by weight of said fiber and the amount of antistatic polymer (B) comprising polyether segments is about 2–45% by weight of said fiber, said antistatic polymer (B) having uniformly dispersed electrically conductive carbon black in an amount of about 10–200% by weight of antistatic polymer (B), and said antistatic polymer (B) extending in the form of long and slender stripes in polymer (A).

2. An antistatic fiber according to claim 1, wherein said antistatic polymer (B) contains a nonionic surface-active agent having polyoxyalkylene segments as a dispersant for said carbon black, and wherein the amount of said dispersant is about 5–30% by weight of said carbon black.

3. An antistatic fiber according to claim 1, wherein a major proportion of antistatic polymer (B) is a polyetherester block copolymer derivative comprising polyester segments and polyether segments of the general formula:

$$-O-(C_2H_4O)_m-(CH_2-\overset{\overset{CH_3}{|}}{C}HO)_n-$$

wherein $m$ is $\geqq 10$, $n$ is 0 or a positive integer and $25 \leqq m+n \leqq 1{,}000$, and a polyetherester block copolymer derivative obtained by graft copolymerizing a copolymerizable vinyl monomer component on a block polyether-ester.

4. An antistatic fiber according to claim 3, wherein the amount of the polyether segments is from about 60 to 90% by weight of block copolymer, and the amount of polyether segments is from about 5 to 40% by weight of block copolymer.

5. An antistatic fiber according to claim 1, wherein the carbon black is furnace black.

6. An antistatic fiber according to claim 1, wherein said acrylic fiber has an electrical resistivity from about $10^6$ to $10^2\Omega$.cm.

7. An acrylic fiber having an electrical resistivity of about $10^8\Omega$.cm. or less, comprising about 55–98% by weight of said fiber of (A) an acrylonitrile homopolymer or copolymer comprising at least about 80 mol% of acrylonitrile and up to about 20% of at least one copolymerizable vinyl monomer and about 2–45% by weight of said fiber of (B) an antistatic polymer comprising a plurality of polyether segments disposed in said polymer (A) in the form of long and slender stripes, said antistatic polymer (B) being a polyalkylene glycol derivative containing an alkylene glycol having an average molecular weight of 2,000 – 20,000 as the main unit, and wherein about 10–200% by weight of antistatic polymer (B) of electrically conductive carbon black is uniformly dispersed in antistatic polymer (B).

8. A method for producing an antistatic fiber which comprises (1) mixing 55–98% by weight of total polymer of an acrylonitrile fiber-forming homopolymer (A) comprising at least about 80 mol% of acrylonitrile and up to about 20% of at least one copolymerizable vinyl monomer and 2–45% by weight of total polymer of an antistatic polymer (B) derived from polyether segments which are miscible but incompatible with the acrylonitrile homopolymer or copolymer containing 10–200% by weight of an antistatic fiber of uniformly dispersed carbon black, spinning said mixed polymer solution, and drawing the resulting fibers to shape the antistatic polymer (B) containing carbon black into long and slender stripes in the acrylonitrile polymer (A).

9. A method according to claim 8, wherein antistatic polymer (B) solution contains a nonionic surface-active agent having polyoxyalkylene segments as the dispersant of carbon black, and the amount of said dispersant is about 5–300% by weight of carbon black.

10. A method according to claim 8, wherein a major proportion of antistatic polymer (B) is a block polyether-ester derivative comprising polyester segments and polyether segments of the general formula $$-O-(C_2H_4O)_m(CH_2-\overset{\overset{CH_3}{|}}{C}HO)_n-$$

wherein $m$ is $\geqq 10$, $n$ is 0 or a positive integer and $25 \leqq m+n \leqq 1{,}000$, and a block polyether-ester derivative obtained by graft copolymerizing a copolymerizable vinyl monomer component on a block polyether-ester.

11. A method according to claim 8, wherein the amount of the polyester segments is from about 60–95% by weight of said block polyether-ester, and the amount of polyether segments is from about 5–40% by weight of said block polyether-ester.

12. A method for producing an antistatic fiber according to claim 8, whrein said carbon black is furnace black.

13. In a method for producing an antistatic filament, the steps which comprise providing 55–98% by weight of total polymer of a substantially non-conducting acrylonitrile polymer (A) comprising at least about 80 mol% of acrylonitrile and up to about 20% of at least one copolymerizable vinyl monomer and providing 2–45% by weight of total polymer of an antistatic polyether polymer (B) derived from polyether segments which are miscible but incompatible with the acrylonitrile homopolymer or copolymer in which carbon black particles in an amount of 10–200% of polymer are uniformly suspended, coextruding said polymer (A) in intimate contact with said polymer (B) and with said carbon black particles to form a fluid filament composed of both said polymers (A) and (B) in physical contact and engagement with each other, said carbon black particles having greater affinity for said polymer (B) than for said polymer (A), and solidifying said fluid filament to form segments of polymer (B) with substantially all of said carbon black particles contained in said segments of polymer (B) and substantially none of said carbon black particles contained in said polymer (A).

14. The method defined in claim 13, further including the step of drawing the resulting filament.

* * * * *